US005765636A

United States Patent [19]

Meyer et al.

[11] Patent Number: 5,765,636

[45] Date of Patent: Jun. 16, 1998

[54] AIR CIRCULATION CONTROLLER WITH SHORT-CYCLE PREVENTION CAPABILITY

[75] Inventors: Jeffrey R. Meyer, Minneapolis; Gary A. Smith, Plymouth, both of Minn.

[73] Assignee: Honeywell Inc., Minneapolis, Minn.

[21] Appl. No.: 684,525

[22] Filed: Jul. 19, 1996

[51] Int. Cl.[6] ..... F25B 29/00; F23N 5/20

[52] U.S. Cl. ..... 165/247; 165/244; 165/267

[58] Field of Search ..... 165/244, 247, 165/267, 54; 236/49.3

[56] References Cited

U.S. PATENT DOCUMENTS 4,838,482 6/1989 Vogelzang ..... 236/11

5,582,233 12/1996 Noto ..... 165/247

*Primary Examiner*—Harold Joyce

*Attorney, Agent, or Firm*—Charles L. Rubow

[57] ABSTRACT

A method and system for improving indoor air quality by controlling the circulation of air by a system fan of a conventional environmental control system in order to achieve a minimum circulation cycle. The method and system prevent nuisance short cycling of the system fan by extending the circulation cycle when the method and system predict the system fan will be activated by the environmental control system for heating or cooling shortly after the termination of the controlled circulation.

13 Claims, 7 Drawing Sheets

Steady State System Cycling Using Anticipator

AIR CIRCULATION CONTROLLER WITH SHORT-CYCLE PREVENTION CAPABILITY

FIELD OF THE INVENTION

This invention generally pertains to the field of environmental control, and more specifically to a method and system for improving indoor air quality by maintaining air circulation at least a minimum percentage of the time, while avoiding short cycling of the circulation fan.

BACKGROUND OF THE PRIOR ART

In a typical heating, ventilating, and air conditioning (HVAC) system, one or more fans are used to distribute heated or cooled air, or to provide ventilation. In for heating, cooling or ventilation systems the fans are typically driven only when necessary such. When a fan is not needed for such a purpose, it is disengaged by the system. This traditional approach may result in the long periods of fan inactivity depending upon environmental conditions. For example, in mild temperatures heating or cooling may not be needed for relatively long intervals. This results in a degradation of indoor air quality since the air becomes stale and does not pass through a filter in the system during the period of inactivity.

It is well known in the art to give the user the ability to set a system fan in "automatic" or "continuous"to modes. In the automatic mode the fan is automatically driven when needed by the system. In continuous mode, the fan is continuously driven. This mode allows the user to control the indoor air quality by continuously circulating air and forcing the air through the filter which is typically present on standard HVAC equipment.

However, this approach has several disadvantages. One disadvantage is that it requires manual intervention by the user to turn the fan control to continuous in order to achieve sufficient air circulation when the HVAC system is not driving the fan. Another disadvantage is that leaving the fan on continuously may result in energy waste. Therefore there exists a need in the art to allow the user to improve the indoor air quality, by circulating air through the indoor space and through the filter, without leaving the fan on or manually changing its operating state.

SUMMARY OF THE INVENTION

To overcome these and other problems in the prior art, we have provided a method and system for improving the indoor air quality by automatically cycling control of circulating air through the indoor space and through the system filter.

According to one feature of the invention, a control establishes a minimum fan duty cycle which is sufficient to circulate air for improved indoor air quality, while conserving energy. The active period of the duty cycle may be a value chosen according to the intended application. For example, in a preferred embodiment the active period of the duty cycle is set at 33% based on the last fan cycle.

Another feature of the invention is that it avoids nuisance or short duty activations of the fan while achieving the above noted circulation function. Depending upon environmental and operating conditions, the HVAC system might try to activate the fan shortly after the termination of a fan operation period which had been established by circulation criteria. If so, this would result in engaging the fan shortly after the fan has disengaged. This is referred to as a short fan cycle, and would be considered a nuisance to the home owner, or may cause him or her to believe the HVAC system is not properly adjusted. The same thing might occur if the circulation control attempted to initiate a fan operation period shortly after the HVAC system had ended a fan activation period. One feature of the invention is to avoid such short fan cycles by predicting the state of the system at a future time and adjusting operations accordingly.

These and other features and advantages of the invention will become apparent from the following description of the preferred embodiments of the invention.

DESCRIPTION OF THE PREFERRED EMBODIMENT

In the following detailed description, references are made to the accompanying drawings which form a part hereof, and in which is shown by way of illustration specific embodiments in which the invention may be practiced. These embodiments are described in sufficient detail to enable those skilled in the art to practice and use the invention. It is to be understood that other embodiments may be utilized and that electrical, logical, and structural changes may be made without departing from the spirit and scope of the present invention. The following detailed description is, therefore, not to be taken in a limiting sense. The scope of the present invention is defined by the appended claims and their equivalents.

Figure 1:
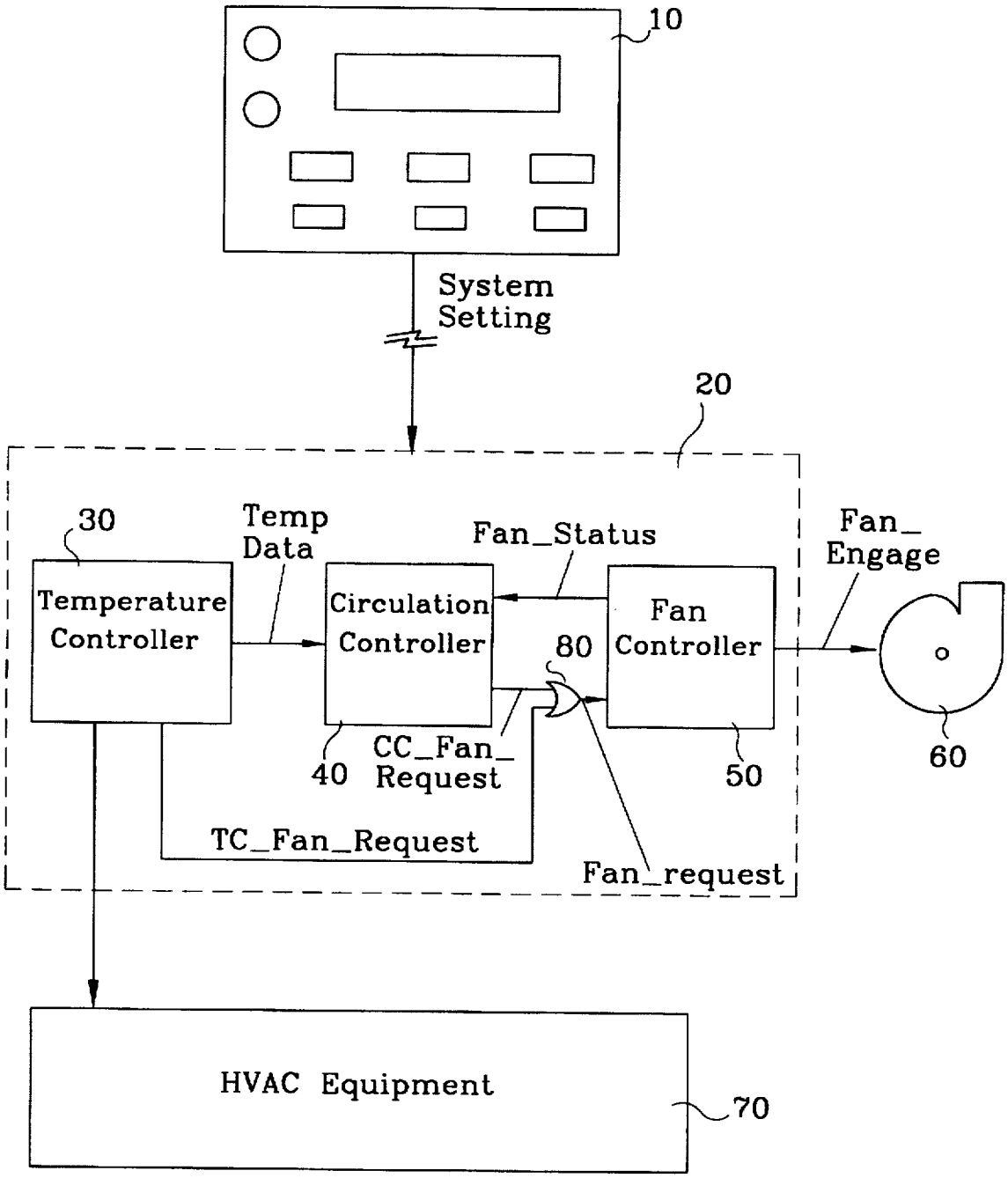
FIG. 1 is a block diagram of a heating, cooling and ventilating system in which the present invention may be implemented.

FIG. 1, illustrates an HVAC system in which the present invention may be embodied. The HVAC system includes a user interface 10 which receives inputs from the user and displays information for viewing. Among other settings, the user may select any of three modes for fan operation, namely AUTO, ON, and CIRC. These settings correspond to automatic, continuous, and circulatory fan operation, respectively. The setting received from the user is communicated to a remote sub-base 20 which is located near the heating, ventilation, and air condition (HVAC) equipment 70.

The remote sub-base 20 comprises a temperature controller 30 which provides temperature data to a circulation controller 40. The temperature data contains current information regarding the temperature and the state of the HVAC equipment 70 such as whether HVAC equipment 70, is being energized. The temperature controller 30 has an output line TC_fan_request which is asserted when the temperature controller 30 is requesting the fan be engaged. Circulation controller 40 also has an output line CC_fan_request for requesting fan activation. Both output lines feed into OR gate 80 which drives the fan_request of a fan controller 50. When fan_request is driven by OR gate 80, fan controller 50 drives output line fan-engage to activate the circulation fan 60. Fan controller 50 produces fan_status signal which is monitored by circulation controller 40 to determine whether or not the circulation fan 60 is engaged.

Figure 2:
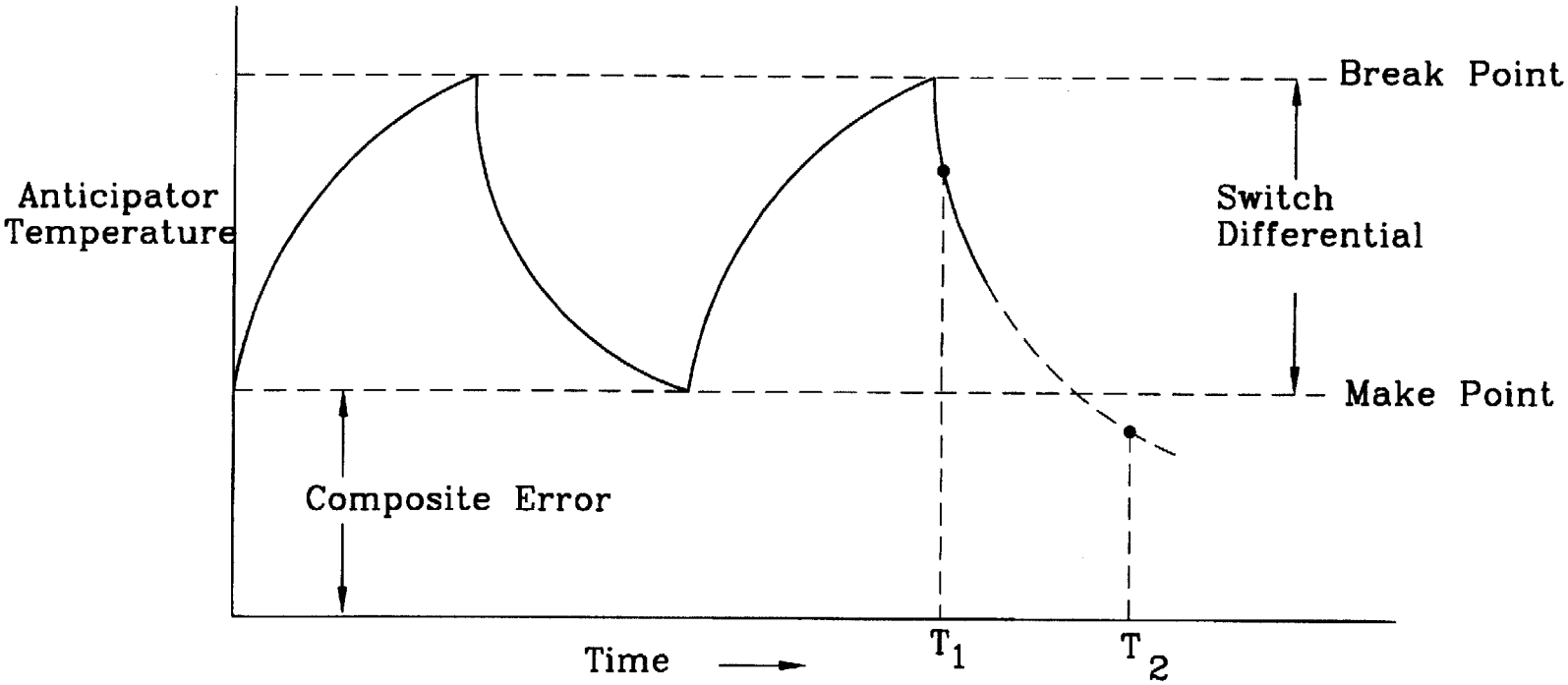
FIG. 2 is an illustration of the steady state cycling of the anticipator temperature of typical HVAC equipment.

FIG. 2 is an illustration of the steady state cycling of typical HVAC equipment 70. The function of the temperature controller 30 is to maintain space temperature at a desired level by controlling the amount of heat delivered to the space by HVAC equipment 70. Temperature controller 30 is modeled after traditional thermostats which contain a mechanical heat source. The heat source is used to add and remove heat from the thermostat when the thermostat cycles its controlled equipment on and off, respectively. The heating element inside traditional thermostats allows the thermostat to anticipate the space temperature.

FIG. 2 graphs the current anticipator temperature of a thermostat versus time as HVAC equipment 70 is operated. When the anticipator temperature reaches the "break point" (deactivation temperature), the HVAC equipment 70 is deactivated and the anticipator begins to cool. When the anticipator temperature reaches the "make point"(activation temperature) the HVAC equipment is activated again.

The rate of rise or fall of the anticipator temperature is determined by a multiplier called the "anticipator factor" and is set to match the mechanical characteristics of the environment which the system controls. The temperature controller 30 uses proportional plus integral control. Therefore, the composite error is the sum of the proportional temperature error and the integral temperature error and is essentially the "make point" of the system.

In one embodiment, temperature controller 30 is implemented with a switch differential of one degree. The switch differential, as indicated in FIG. 2, is the difference between the "make point" and the "break point". Alternative embodiments may be used to vary the "make point" and "break point".

As illustrated in FIG. 2, the circulation controller extends the anticipator temperature in order to calculate a future anticipator temperature. For example, at a time $T_1$, the HVAC equipment is currently de-energized and the current anticipator temperature is known. Therefore, using the anticipator factor for HVAC equipment 70 circulation controller 40 can calculate anticipator temperature at a future time $T_2$. If the future anticipator temperature is below the "make point", then HVAC equipment will be active at $T_2$. As will be described in detail below, circulation controller 40 anticipates the future state of HVAC equipment 70, and prevents short-cycling of system fan 60 while circulating air.

Figure 3A:
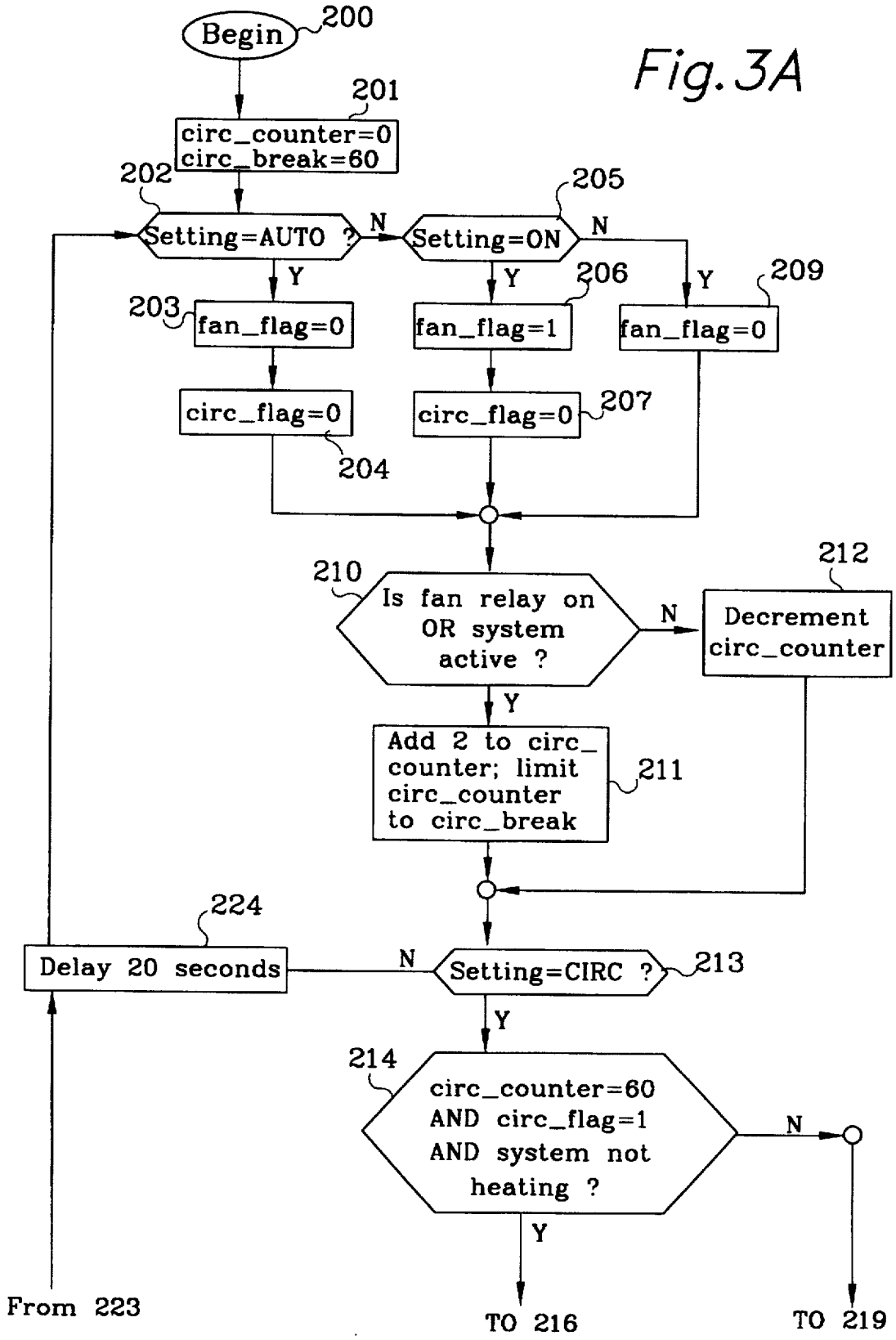
FIGS. 3A and 3B are a flow chart illustrating a mode of operation of the air circulation controller of FIG. 1.
Figure 3B:
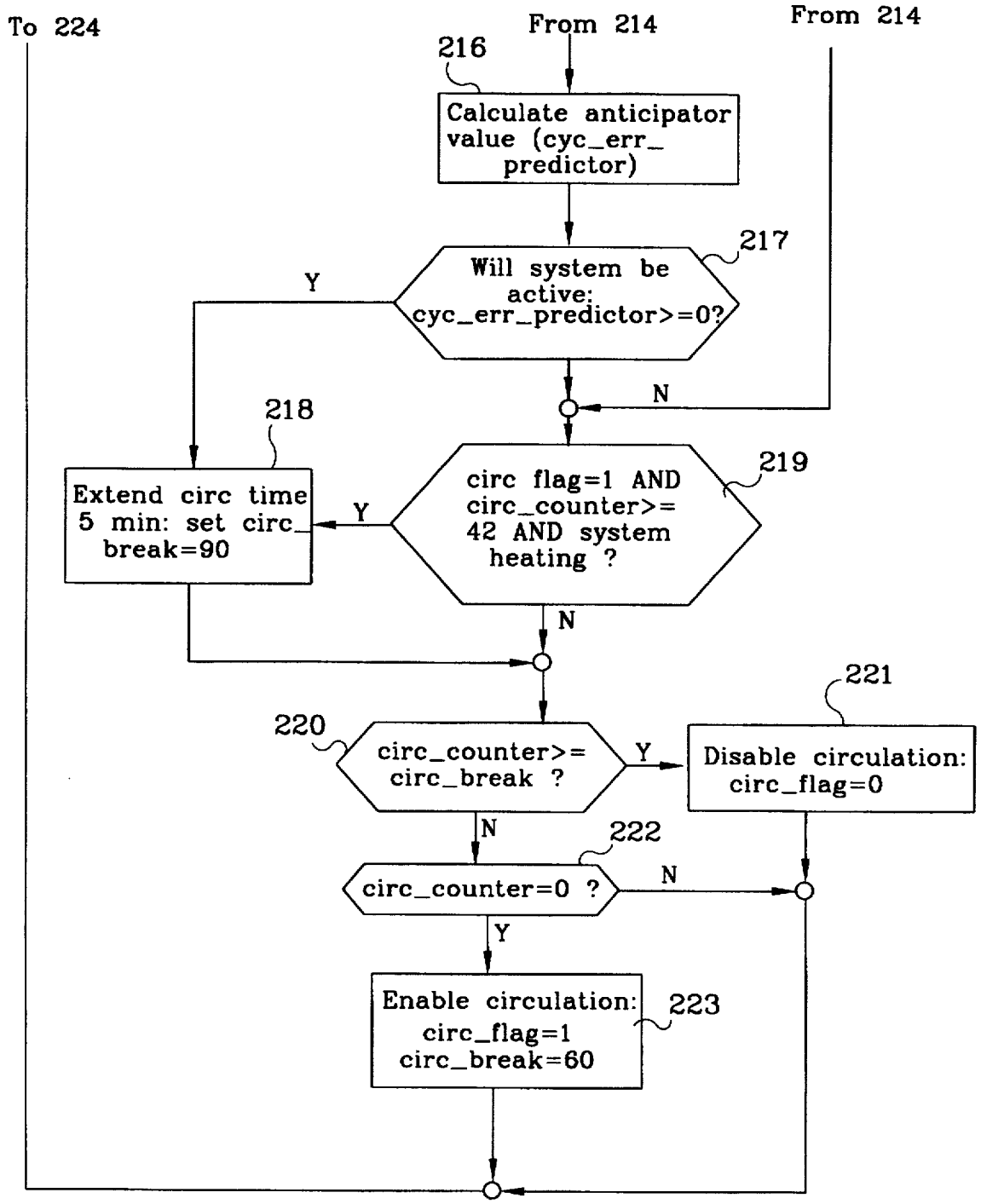

FIGS. 3A and 3B are a flow chart suitable for implementing circulation controller 40 so as to improve air quality by circulating the air while preventing short cycles of the fan. The program for circulation control begins at starting block 200 and proceeds to processing block 201 which initializes variable circ_counter to zero and variable circ_break to sixty. As will become apparent below, the program uses circ_counter as an up-down counter to implement the duty cycle of circulation fan 60.

After initializing the variables, the program proceeds to decision block 202 which tests the fan setting received from user interface 10. If the fan setting is AUTO, then the variables fan_flag and circ_flag are cleared by processing blocks 203 and 204 respectively. The program then proceeds to decision block 210. If decision block 202 fails because fan setting is not AUTO, control proceeds to decision block 205 which compares fan setting to ON. If the fan setting is ON, then fan_flag is set to one by processing block 206 and circ_flag is cleared by processing block 207. The program control then proceeds to decision block 210. If decision block 205 fails because the setting is not ON, the program assumes the fan setting is CIRC and control flows to processing block 209 which clears the fan_flag. Control then proceeds to decision block 210.

Decision block 210 examines fan_status received from fan controller 50 and the temperature data received from temperature controller 30. If the fan is currently active or the system is currently heating or cooling the program proceeds to processing block 211 which adds two to a local variable, circ_counter. If circ_counter is greater than circ_break, then circ_counter is limited to the value of circ_break. If decision block 210 fails because fan_status is logic false and the system is not active, control flows to processing block 212 which simply decrements circ_counter. Therefore, in the described embodiment, the ratio of the increment constant to the decrement constant is 2:1 therefore system fan 60 is active for one half the time that it is inactive. In this manner, the present embodiment produces a duty cycle where the fan is active for 33% of the total cycle. It will be readily recognized by one skilled in the art that one embodiment of the invention could decrement the count when the system fan is active and increment the count when the system fan is idle. Therefore, reversing the direction and the constants will achieve a similar result to the described invention. Thus, the increment and decrement constants are understood to be either positive or negative without departing from the spirit of the invention. In another embodiment, a different duty cycle of circulation fan 60 may be readily achieved by changing the ratio of the increment constant to the decrement constant. Program control proceeds from both processing block 211 and 212 to decision block 213.

Decision block 213 tests the fan setting received from user interface 10. If the fan setting does not equal circulation (CIRC) then the program flows to processing block 224 which simply delays twenty seconds and then proceeds back to block 202 where the program begins circulation control again. In this manner, in the preferred embodiment, circulation control is executed every twenty seconds. The system suitable for implementing the illustrated method in FIGS. 3A and 3B may utilize the twenty second delay to service other events or components. Alternatively, a different fixed time period may readily be used without substantive changes to the invention.

Figure 4A:
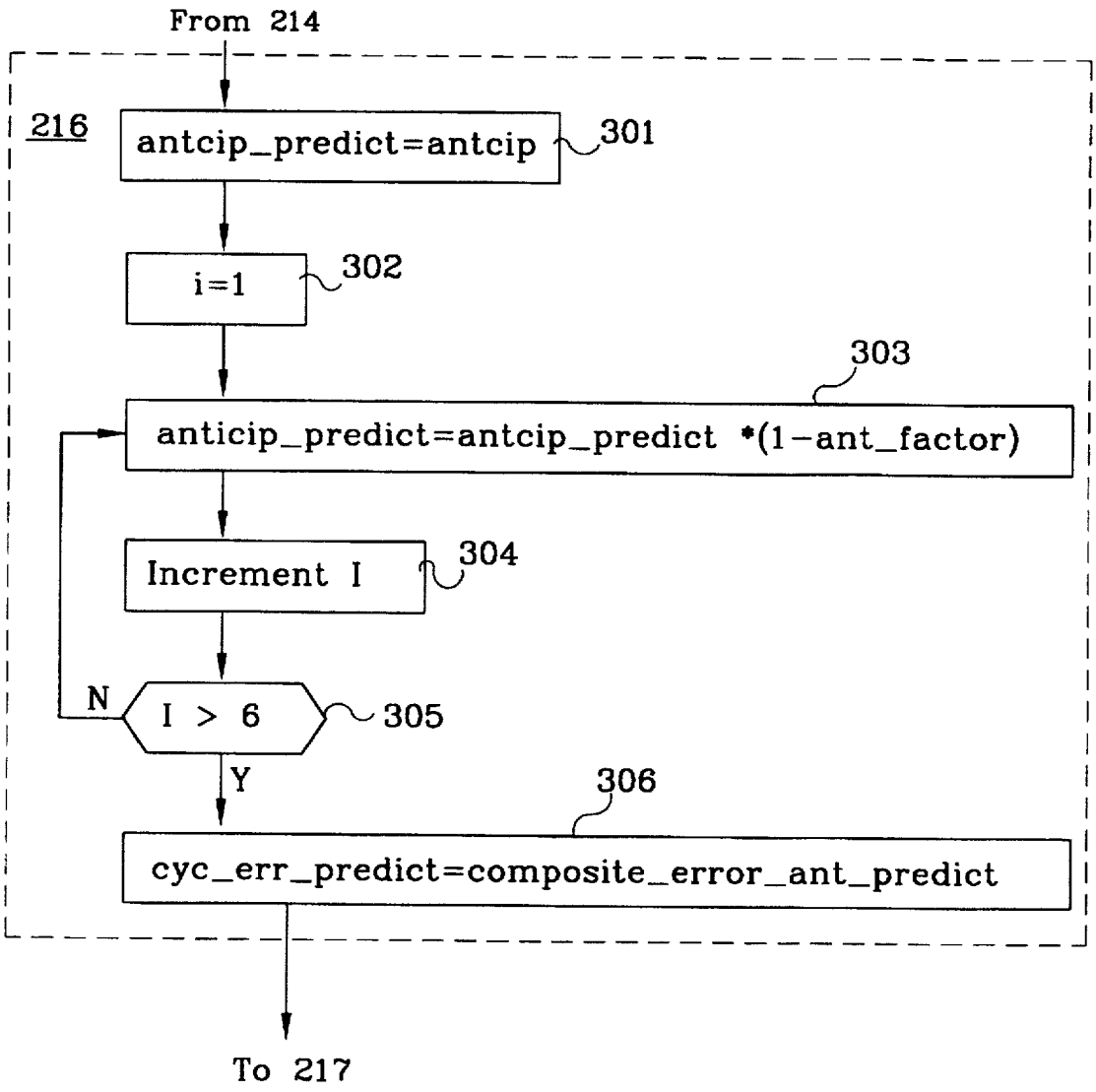
FIGS. 4A and 4B are flow charts illustrating alternative methods of predicting the system state at a fixed future time.
Figure 4B:
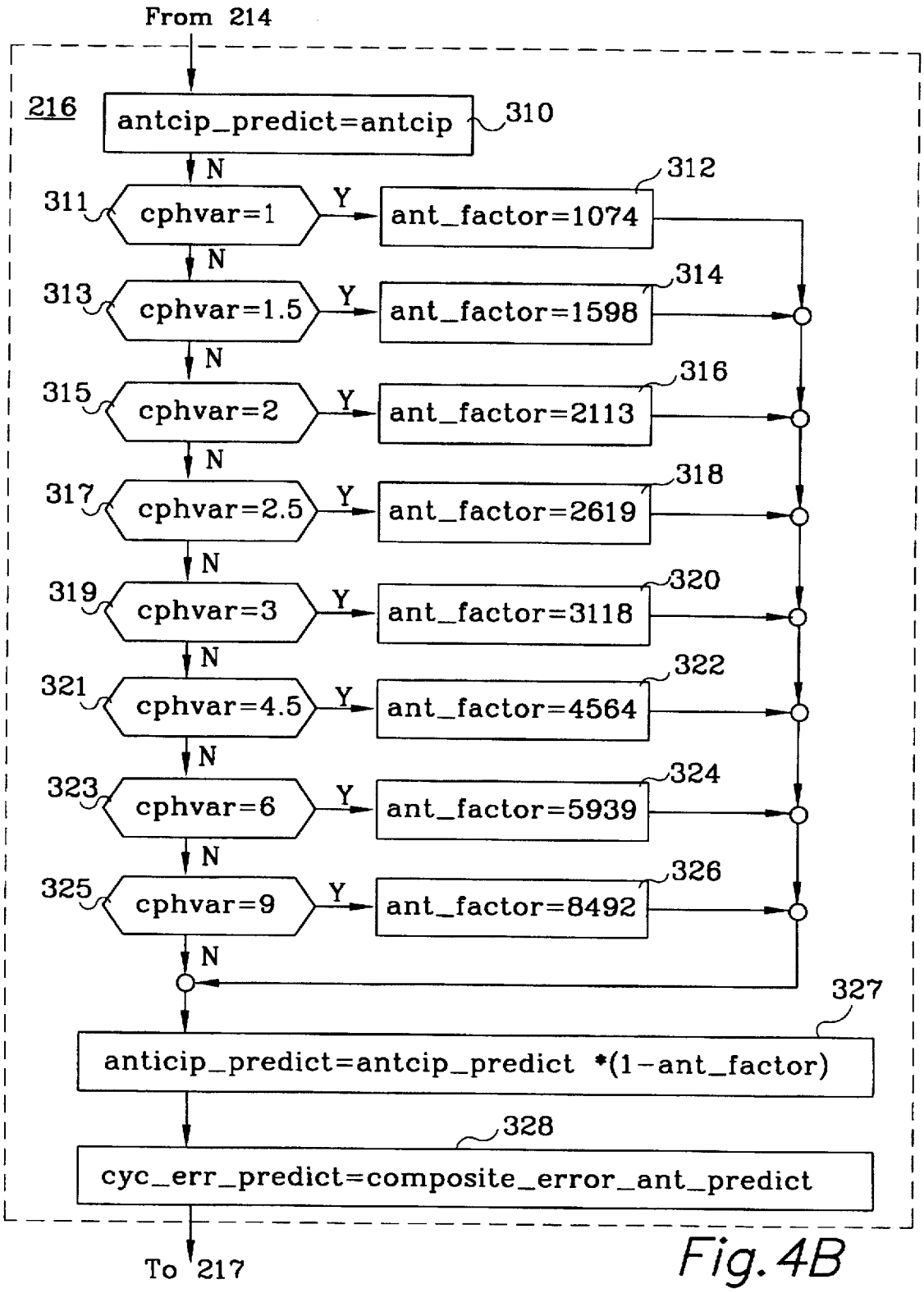

If decision block 213 is successful because the fan setting is set to circulation mode, the program proceeds to decision block 214. Decision block 214 first determines whether the system is currently circulating air by determining if circ_flag is set to one. Next, decision block 214 determines if circ_counter is greater than or equal to 60 which is an indication that air circulation should be terminated because the portion of the duty cycle where the fan is engaged has completed. Finally, decision block 214 determines whether the temperature data received from temperature controller 30 indicates that the system is not currently heating or cooling. If any of the three conditions are not satisfied, the program proceeds to decision block 219; however, if all three conditions are satisfied, the program proceeds to processing block 216. Since air circulation is about to terminate, processing block 216 performs the prediction algorithm to determine whether temperature controller 30 will be energizing HVAC equipment 70 at a future fixed time. In the preferred embodiment illustrated by FIGS. 3A and 3B, the fixed time is two minutes in the future. If the system is predicted to be energized within two minutes, the anticipator temperature, variable cyc_err_predictor, is set to a positive number. FIGS. 4A and 4B illustrate alternative methods for anticipating the system's state and will be discussed in detail below.

After processing block 216 calculates the anticipator temperature, the program proceeds to decision block 217. Conditional block 217 tests the anticipator temperature to determine if the system is predicted to be active. An anticipator temperature greater than or equal to zero indicates that HVAC equipment 70 will be energized within two minutes; therefore, terminating the circulation of air will be followed by a short fan cycle illustrated in FIG. 5. In order to prevent the short fan cycle, the program proceeds to processing block 218 which extends the circulation time by five minutes. In the described embodiment, this is accomplished by changing the upper limit on the circulation counter, circ_break, from sixty to ninety. By increasing the counter by thirty, processing block 216 effectively increases the number of iterations by fifteen since the counter is incremented by two every time through the loop when the fan is active. Since the program is executed every twenty seconds in the preferred embodiment, the increase of fifteen iterations results in a net time increase of three hundred seconds or five minutes.

If decision block 217 fails because the anticipator temperature is less than zero then processing block 218 is bypassed and control proceeds to decision block 219. Decision block 219 first tests whether the system is currently circulating by checking if circ_flag is set to one. Next, decision block 219 tests whether circulation controller 40 is within three minutes from ending air circulation by determining if circ_counter is greater than or equal to 42. Finally, decision block 219 tests whether the temperature data received from temperature controller 30 indicates that the system is currently heating. If all three conditions are satisfied then a short duty cycle will occur, as described in FIG. 6, unless circulation controller 40 prevents its occurrence. In order to prevent the short duty cycle, the program proceeds to processing block 218 which extends the circulation time by five minutes as explained earlier. This extension in time ensures that circulation controller 40 drives circulation fan 60 until temperature controller 30 has preheated HVAC equipment 70 and has engaged the fan by asserting its fan request line, TC_fan_request.

If decision block 219 fails, control proceeds to decision block 220 which examines the circulation counter to determine if it has reach its maximum value indicating the engaged period of the duty cycle has ended and circulation fan 60 should be disengaged. This is determined by seeing if circ_counter is greater than or equal to circ_break. Note, in the preferred embodiment, circ_break may be set to 60 or extended to 90 in order to prevent short cycles of the fan. If the test is successful, control proceeds to processing block 221 which disables circulation by removing CC_fan_request and setting the variable circ_flag to zero. After disabling circulation, control proceeds from processing block 224. If the test of decision block 220 fails, the control proceeds to decision block 222 which examines the circulation counter to determine if it has reached zero which indicates the disengaged period of the duty cycle has completed and the fan should be engaged to begin circulating air. If circ_counter equals zero, control proceeds to processing block 223 which enables circulation by asserting the CC_fan_request input line to OR gate 80 thereby asserting fan_request input line to the fan controller. Processing block 223 also resets circ_break to the normal threshold 60 and sets circ_flag equal to one.

Program control flows from processing block 223 and processing block 221 to processing block 224. As described above, processing block 224 delays 20 seconds and control proceeds to decision block 202 where the control loop is repeated.

FIG. 4A illustrates a first method for implementing processing block 216 which performs the prediction algorithn to determine whether temperature controller 30 will be energizing HVAC equipment 70 at a future fixed time. In the described embodiment, processing block 216 performs an anticipator look-ahead scheme which determines the state of temperature controller 30 in two minutes. The look-ahead scheme calculates the future anticipator temperature by iterating through an anticipation equation six times, the equivalent to two minutes in the future.

First, processing block 301 retrieves the current anticipator temperature from the temperature data received from temperature controller 30 and stores it in the variable anticip_predict. Next, control proceeds to processing block 302 which sets variable i to one. Next, processing block 303 multiplies anticip_predict by (1–anticipator factor).

From processing block 303, control proceeds to processing block 304 which increments the value of variable i. Next, decision block 305 examines i to determine if it is greater than six. If not, control branches back to processing block 303. If the variable i is greater then six, then control proceeds to processing block 306. In this manner, the loop is executed six times.

Once the future anticipator temperature is calculated, the cycling error can be calculated. In temperature controller 30, the cycling error is used to drive stage switching hysteresis action. As described above, a cycling error of zero or greater means temperature controller 30 will energize HVAC equipment 70 within the next two minutes. A cycling error less than zero indicates HVAC equipment 70 will be off. Processing block 306 calculates the cycling error by subtracting the computed future anticipator temperature from the composite error received from temperature controller 30. After the cycling error, cyc_err_predict, is calculated, the program proceeds to decision block 217.

FIG. 4B illustrates an alternate method for implementing processing block 216 which determines whether temperature controller 30 will be energizing the HVAC equipment 70 at a future fixed time. The method illustrated by FIG. 4B uses a lookup table for providing an anticipator factor for a two minute increment based upon the cycles per hour of the system. The embodiment illustrated in FIG. 4B is based upon a two minute prediction and is exemplary only.

The second method for implementing processing block 216 begins at processing block 310 which retrieves the current anticipator temperature from the temperature data received from temperature controller 30 and stores it in anticip_predict. Next, the program proceeds to decision block 311 which compares the cycles per hour variable cphvar to one. If the comparison is successful, then processing block 312 sets the anticipator factor by loading the variable ant_factor with 1074. If not, program flow proceeds to decision block 313. Similarly, decision blocks 313, 315, 317, 319, 321, 323, and 325 compare cphvar to a preset cycles per hour. Once the comparison is satisfied, ant_factor is set to a value obtained from a lookup table and the program proceeds to processing block 327. If the comparison is not satisfied in any of the decision blocks, the control flows to the next decision block in the series. Processing block 327 sets the future anticipator temperature equal to the multiplication of the current anticipator temperature and (1–ant_factor). The cycling error is calculated by processing block 328 which subtracts the computed anticip_predict from the composite error received from the temperature controller 30.

Figure 5:
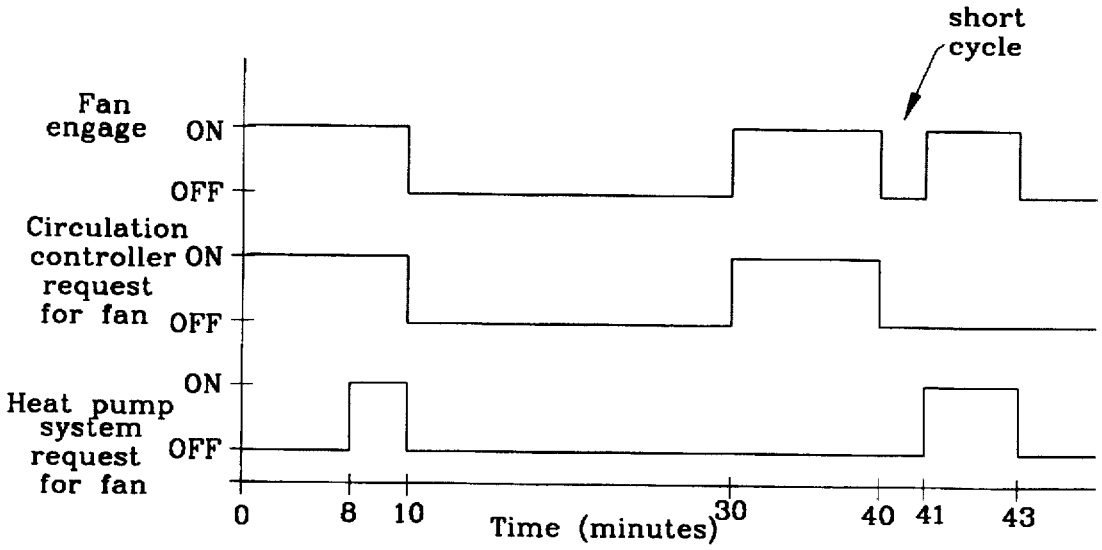
FIG. 5 is a timing diagram illustrating a short fan cycle which may occur in an HVAC system, and which the present invention prevents.

FIG. 5 is a timing diagram which illustrates a short fan cycle which may occur in a typical heat pump system when air circulation is attempted. Three signals are depicted, the fan status, the circulation controller request for activating the fan, and the HVAC system request for activating the fan. The diagram illustrates the problem created when the HVAC system begins driving the fan shortly after the circulation controller finishes circulating air. The result is a short fan cycle where the fan briefly shuts off. As discussed above, this occurrence is a nuisance which may mislead the user into believing the system is operating incorrectly.

Figure 6:
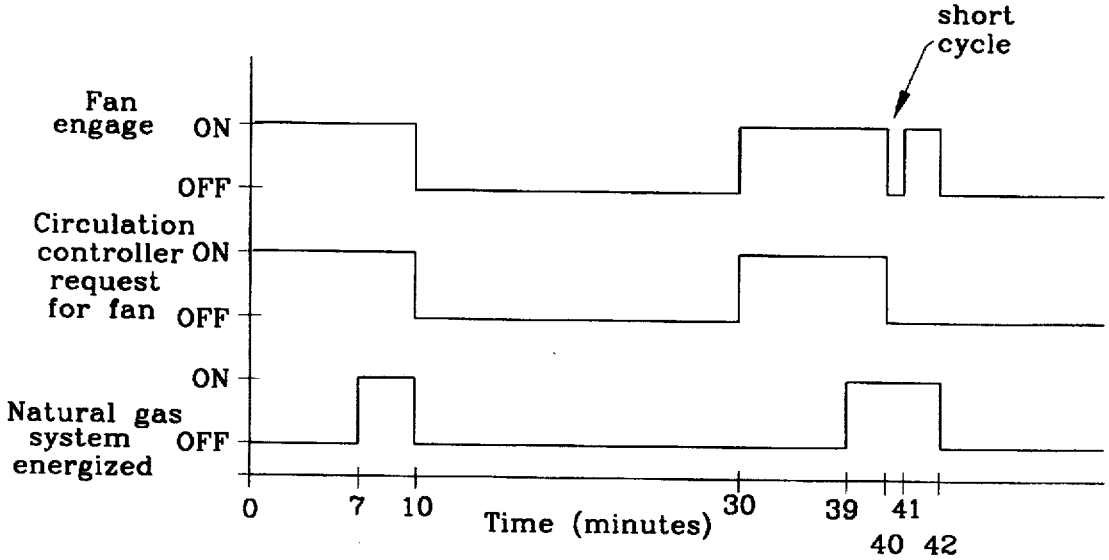
FIG. 6 is a timing diagram illustrating a short fan cycle which may occur in a natural gas fueled heating system, and which the present invention prevents.

FIG. 6 is a timing diagram which illustrates a short fan cycle which would be present in a typical natural gas fueled heating system when air circulation is attempted. Again, three signals are depicted, the fan status, the circulation controller request for activating the fan, and the signal corresponding to the energizing of a natural gas system. It is known in the art that a natural gas fueled heating system preheats its first stage when the system is first energized. Some time later, typically one to two minutes, the system will engage the fan to distribute the heat. The diagram illustrates the problem created when the system is preheating at the time the circulation controller finishes circulating air. Shortly thereafter, the natural gas system begins driving the fan. The result again is an undesirable short fan cycle.

We claim:

1. A method for controlling the circulation of air for improving indoor air quality of a building having an environmental control system including a system fan, comprising the steps of:

a) receiving system settings from a user interface indicating that a user desires controlled air circulation;

b) engaging the system fan for a circulating air based upon the system settings;

c) predicting future operation of the system fan due to operation of the environmental control system;

d) modifying the first interval of time as a function of the predicted operation of the environmental control system in order to prevent nuisance short cycling of the system fan;

e) disengaging the system fan for a second interval of time such that the ratio of the first interval of time to the second interval of time achieves a minimum desired circulation cycle; and f) continuously repeating steps b) through e) while the system settings circulation control mode is selected.

2. The method for controlling the circulation of air according to claim 1, wherein the first interval of time is modified to prevent nuisance short cycling of the system fan when the system fan is currently engaged for circulating air and the environmental control system is preheating.

3. A method of operating a system fan in a heating, ventilating, and air conditioning (HVAC) system of the type which has a temperature controller which generates an anticipator temperature having a rise and fall rate according to an anticipator factor based on thermal characteristics of the HVAC system, in order to circulate air in a ventilation system of a building to improve the indoor air quality, comprising the steps of:

a) receiving system settings from a user interface indicating that a user has selected a controlled air circulation mode;

b) engaging the system fan for circulating air based upon the selected mode;

c) maintaining the system fan engaged for a first interval of time;

d) predicting the state of the system fan as will be controlled by the HVAC system at a predetermined future time;

e) modifying the first interval of time of the maintaining step based on the predicted state of the system fan to prevent nuisance short cycling of the system fan;

f) disengaging the system fan for a second interval of time such that the ratio of the first interval of time to the second interval of time achieves the desired circulation cycle; and g) continuously repeating steps b) through f) while the controlled air circulation mode is selected.

4. The method of operating a system fan according to claim 3, wherein said modifying step comprises extending the first interval of time of said maintaining step to prevent nuisance short cycling of the system fan when said predicting step determines the system fan will be engaged at the predetermined future time.

5. The method of operating a system fan according to claim 3, wherein the temperature controller has a proportional error and an integral error and wherein said predicting step comprises the steps of:

a) retrieving the anticipator temperature of the HVAC system from the temperature controller;

b) determining a future anticipator temperature of the system, corresponding to the predetermined future time, based on the anticipator temperature from the temperature controller and the anticipator factor of the HVAC system;

c) calculating a composite error for the system temperature controller according to the proportional error and the integral error of the temperature controller; and e) comparing the future anticipator temperature to an activation temperature of the HVAC system according to the composite error.

6. The method of operating a system fan according to claim 5, wherein said step of determining a future anticipator temperature corresponding to a predetermined future time comprises the steps of:

a) determining an intermediate anticipator temperature corresponding to a fixed time increment based on the current anticipator temperature ant the anticipator factor; and c) repeating the determining step a number of times corresponding to the ratio of the fixed time increment to the predetermined future time.

7. The method of operating a system fan according to claim 5, wherein said step of calculating the future anticipator temperature corresponding to a predetermined future time comprises the step of retrieving the future anticipator factor from a lookup table.

8. A method of operating a system fan in a heating, ventilating, an air conditioning (HVAC) system of the type which has a temperature controller which generates an anticipator temperature having a rise and fall rate according to an anticipator factor based on thermal characteristics of the HVAC system, in order to circulate air in a ventilation system of a building to improve the indoor air quality, comprising the steps of:

a) receiving system settings from a user interface indicating that a user desires controlled air circulation;

b) decreasing a count by a first constant if the HVAC system is not active;

c) increasing the count by a second constant if the HVAC system is active where the ratio of the second constant to the first constant determines a duty cycle of the system fan;

d) disengaging the system fan when the count reaches an upper threshold;

e) engaging the system fan when the count reaches a lower threshold;

f) continuously repeating steps b) through e) while circulation control mode is selected.

9. The method of operating a system fan according to claim 8 further comprising the step of increasing the upper threshold to prevent nuisance short cycling of the system fan when the count approaches the upper threshold and the environmental control system is preheating.

10. The method of operating a system fan according to claim 8 further comprising the steps of:

a) predicting the state of the system fan, as will be controlled by the HVAC system at a predetermined future time, when the count approaches the upper threshold; and b) increasing the upper threshold based on the predicted state of the system fan to prevent nuisance short cycling of the system fan by extending the time the system fan is engaged.

11. The method of operating a system fan according to claim 10, wherein the temperature controller has a proportional error and an integral error and wherein said predicting step comprises the step of:

a) retrieving the anticipator temperature of the HVAC system from the temperature controller;

b) determining a future anticipator temperature of the system, corresponding to the predetermined future time, based on the anticipator temperature from the temperature controller and the anticipator factor of the HVAC system;

c) calculating a composite error for the system temperature controller according to the proportional error and the integral error of the temperature controller; and e) comparing the future anticipator temperature to an activation temperature of the HVAC system according to the composite error.

12. A method of operating a system fan according to claim 11, wherein said step of determining a future anticipator temperature corresponding to a predetermined future time comprises the steps of:

a) determining an intermediate anticipator temperature corresponding to a fixed time increment based on the current anticipator temperature and the anticipator factor; and c) repeating the determining step a number of times corresponding to the ratio of the fixed time increment to the predetermined future time.

13. A method of operating a system fan according to claim 12, wherein said step of calculating the future anticipator temperature corresponding to a predetermined future time comprises the step of retrieving the future anticipator factor from a lookup table.

* * * * *

UNITED STATES PATENT AND TRADEMARK OFFICE

CERTIFICATE OF CORRECTION

PATENT NO. : 5,765,636

DATED : June 16, 1998

INVENTOR(S) : Jeffrey R. Meyer, et al.

It is certified that error appears in the above-indentified patent and that said Letters Patent is hereby corrected as shown below:

Claim 1, line 7, after "fan" insert --for a first interval of time--.

Claim 6, line 7, delete "ant" and insert --and--.

Claim 8, line 2, delete "an" and insert --and--.

Signed and Sealed this

Tenth Day of November 1998

*Attest:*

*Attesting Officer*

BRUCE LEHMAN

*Commissioner of Patents and Trademarks*